US006385808B1

(12) United States Patent
Yamada et al.

(10) Patent No.: US 6,385,808 B1
(45) Date of Patent: May 14, 2002

(54) BI-POSITIONABLE TOOTHBRUSH

(76) Inventors: Todd H. Yamada, 6090 Sepulveda Blvd., Suite 480, Culver City, CA (US) 90230; Gregg M. Yamada, Saint Frances Outpateint Building, 2226 Liliha St., Suite 302, Honolulu, HI (US) 96817

( * ) Notice: Subject to any disclaimer, the term of this patent is extended or adjusted under 35 U.S.C. 154(b) by 0 days.

(21) Appl. No.: 09/403,453

(22) PCT Filed: Feb. 17, 1998

(86) PCT No.: PCT/US98/03518

§ 371 Date: Sep. 28, 2000

§ 102(e) Date: Sep. 28, 2000

(87) PCT Pub. No.: WO98/47405

PCT Pub. Date: Oct. 29, 1998

Related U.S. Application Data

(63) Continuation-in-part of application No. 08/837,548, filed on Apr. 21, 1997, now Pat. No. 5,815,875.

(51) Int. Cl.[7] ..... A46B 9/04

(52) U.S. Cl. ..... 15/167.1; 15/106; 15/185; 125/33; 145/108

(58) Field of Search ..... 15/167.1, 106, 15/185; 125/33; 145/108

(56) References Cited

U.S. PATENT DOCUMENTS 1,473,357 A * 11/1923 Pletman ..... 15/167.1
2,542,038 A * 2/1951 Lewis ..... 125/33
2,742,936 A * 4/1956 Cooley ..... 145/108
2,750,616 A * 6/1956 Klugmann ..... 15/144
4,731,896 A * 3/1988 de la Tour ..... 15/106
5,003,658 A * 4/1991 Rolleri ..... 15/185
5,033,154 A * 7/1991 Marchand et al. ..... 15/167.1
5,228,166 A * 7/1993 Gomez ..... 15/167.1
5,673,453 A * 10/1997 Huang ..... 15/167.1
5,815,875 A * 10/1998 Yamada ..... 15/167.1

* cited by examiner

*Primary Examiner*—Thurman K. Page
*Assistant Examiner*—Charesse L. Evans
(74) *Attorney, Agent, or Firm*—Beehler & Pavitt; David A. Belasco

(57) ABSTRACT

A bi-positional toothbrush comprising a brush head member (18) rotatably mounted to a handle (14) by a cylindrical pin (22) and coil spring (26) is described. The brush head member includes an array of bristles (42) at a forward end and terminates in an essentially flat angled surface (46) at a rearward end. The angled surface includes an axial bore (58) shaped to permanently constrain the forward end of the pin. The handle is elongated and includes at a forward end an essentially flat surface (70) angled at the same angle to the long axis of the handle as the angled flat surface of the brush head member is to its long axis. The angled flat surface of the handle includes an axial bore orthogonal thereto, sized to receive the pin and terminating in a means to rotatable secure the pin within the axial bore. The angled surfaces of the handle and brush head member includes symmetrical locking features (54, 86).

6 Claims, 2 Drawing Sheets

BI-POSITIONABLE TOOTHBRUSH

RELATED APPLICATIONS

This application is a continuation in part of nonprovisional application Ser. No. 08/837,548, filed Apr. 21, 1997 now U.S. Pat. No. 5,815,875 and claims priority therefrom.

FIELD OF THE INVENTION

This invention relates to the field of multi-positionable brushes in general, and, in particular, to bi-positionable toothbrushes.

BACKGROUND OF THE INVENTION

The desirability for certain uses of a toothbrush, the bristle array of which can be moved angularly with respect to the handle has been recognized for more than a 100 years, as evidenced by U.S. Pat. No. 430,909. Since then, there have been issued numerous United States and foreign patents on toothbrushes designed with such capability. Examples are British Patent No. 191,745, issued in 1923; Austrian Patent No. 134,759, issued in 1933; French Patent No. 1,075,819, issued in 1954; German Patent No. 214,298, issued in 1960; French Patent No. 2,450,579, issued in 1979; and U.S. Pat. Nos. 4,731,896, 5,033,154, 5,003,658, 5,228,166 and 5,442,831, issued Aug. 22, 1995, to the present inventor.

The problem with the prior art devices is that they have not met all of the desired features for an angularly adjustable toothbrush. Principal among these features are: effectiveness in holding the angular position in which the toothbrush may be set; simplicity of construction and assembly and related requirement of minimizing the expense of its manufacture; convenience for the user, both from the standpoint of adjusting the angle and from the standpoint of holding the brush during the toothbrushing operation. Prior art brushes have failed adequately to meet one or more of these desirable features.

SUMMARY OF THE INVENTION

In a first embodiment of the invention an angularly adjustable toothbrush may be constructed of two moldable parts and a pin. The two parts are the rotatable brush head member and the handle. The brush head member is elongated and rigid has a predetermined length, with a forward end and an after end. The forward end supports a brush array. The brush array extends laterally from the member's length. The after end of the member is flared and terminates in an essentially flat first surface angled with respect to a long axis of the member. This first angled surface includes a series of synmmetrical locking features. The brush head member has a first axial bore commencing at the first angled surface and which is orthogonal to the angled surface and terminates inwardly. The first axial bore is sized to closely fit a pin secured in the member.

The handle has a predetermined length, with a forward end and an after end. The forward end of the handle is flared and terminates in an essentially flat second surface angled with respect to the long axis of said handle. The second angled surface includes a series of mating symmetrical locking features configured to mate with the symmetrical locking features of the first angled surface of the brush head member. The handle has a second axial bore beginning at the second angled surface and orthogonal to the handle and terminating inwardly.

The pin has a cylindrical cross-section and has a forward end and an after end. The pin includes means for permanently securing the forward end of the pin within the first axial bore. The pin includes, at the after end, a means of being rotatably secured within the second axial bore.

In a variant of the first embodiment the handle includes finger-gripping features. In another variant of the first embodiment of the invention, the symmetrical locking features comprise one or more pairs of v-shaped grooves on the first angled surface of the brush head member and one or more pairs of mating v-shaped projections on the second angled surface of handle. The v-shaped grooves and v-shaped projections extend radially from the first and second axial bores, respectively.

In a second embodiment, the present invention may be constructed of two moldable parts, a pin, a coil spring and a retaining clip. The two parts are the rotatable brush head member and the handle. The brush head member is elongated and rigid has a predetermined length, with a forward end and an after end. The forward end supports a brush array. The brush array extends laterally from the member's length. The after end of the member is flared and terminates in an essentially flat first surface angled at less than 90 degrees with respect to a long axis of the member. This first angled surface includes a series of symmetrical locking features. The brush head member has a first axial bore commencing at the first angled surface and which is orthogonal to the angled surface and terminates inwardly. The first axial bore is sized to closely fit a pin secured in the member.

The handle has a predetermined length, with a forward end and an after end. The forward end of the handle terminates in an essentially flat surface angled to the long axis of the handle at an angle complementary to the included angle between the angled surface of the brush head member and the long axis of the member. The sum of the two angles is approximately 180 degrees. The second angled surface includes a series of mating symmetrical locking features configured to mate with the symmetrical locking features of the first angled surface of the brush head member. The handle has a second axial bore beginning at the second angled surface and orthogonal to the second angled surface and terminating inwardly.

The pin has a cylindrical cross-section and has a forward end and an after end. The pin includes means for permanently securing the forward end of the pin within the first axial bore. The after end of the pin includes an annular groove sized to accommodate a retaining clip.

The second axial bore has an outer portion sized to slidably accommodate the cylindrical pin, a central portion sized to slidably accommodate the pin when surrounded by a coil spring, and an inner portion sized to slidably accommodate the pin. The handle includes at least one transverse opening at the central portion of the second axial bore to permit placement of the coil spring and attachment of the retaining clip. The brush head member is secured to the handle by inserting the coil spring into the central portion of the second axial bore through the transverse opening. The after end of the pin is then inserted into the second axial bore and through the coil spring, and then the retaining clip is attached to the annular groove in the after end of the pin. The coil spring is thereby compressed between the outer portion of the second axial bore and the retaining clip and thus urges the pin to withdraw into the handle.

The brush head is aligned with the handle in a first alternative angular position by pulling the brush head away from the handle until the coil spring is sufficiently compressed that the symmetrical locking features of the brush head member and the handle are disengaged from each other. The brush head member is then twisted with respect to the handle to the desired position and then released allowing the symmetrical locking features of the first angled surface of the brush head member to engage the mating symmetrical locking features of the second angled surface of the handle.

The brush head is aligned with the handle in a second alternative angular position by pulling the brush head away from the handle until the coil spring is sufficiently compressed that the symmetrical locking features of the brush head member and the handle are disengaged from each other. The brush head member is then twisted with respect to the handle approximately 180 degrees and then released allowing the symmetrical locking features of the first angled surface of the brush head member to engage the mating symmetrical locking features of the second angled surface of the handle.

When the handle is twisted to a first position and released so that the symmetrical locking features align, the resulting toothbrush will have an essentially straight configuration. When the handle again pulled partially away from the brush head member and twisted approximately 180 degrees to a second position and the handle is released so that the mating locking features align, the resulting toothbrush will have a handle offset from the brush head member. The offset angle is the difference between 180 degrees and the sum of the included angle between the long axis of the brush head member and its angled surface and the included angle between the long axis of the handle and its angled surface. For example, if the angled surfaces of the brush head member an the handle are each angled at 75 degrees to their long axes, the sum of their included angles would be 150 degrees. The difference between this sum and 180 degrees is 30 degrees, the resulting offset of the handle from the brush head member.

In a variant of the second embodiment the handle includes finger-gripping features. In another variant of the second embodiment of the invention, the symmetrical locking features comprise one or more pairs of v-shaped grooves on the first angled surface of brush and one or more pairs of mating v-shaped projections on the second angled surface of handle. The v-shaped grooves and v-shaped projections extend radially from the first and second axial bores, respectively.

It may thus be seen that the present invention provides an easily adjustable angled toothbrush of a simple design which may be fabricated of two molded parts, a pin, a coil spring and retaining clip, all of which are easily assembled.

DESCRIPTION OF THE PREFERRED EMBODIMENT

Figure 1:
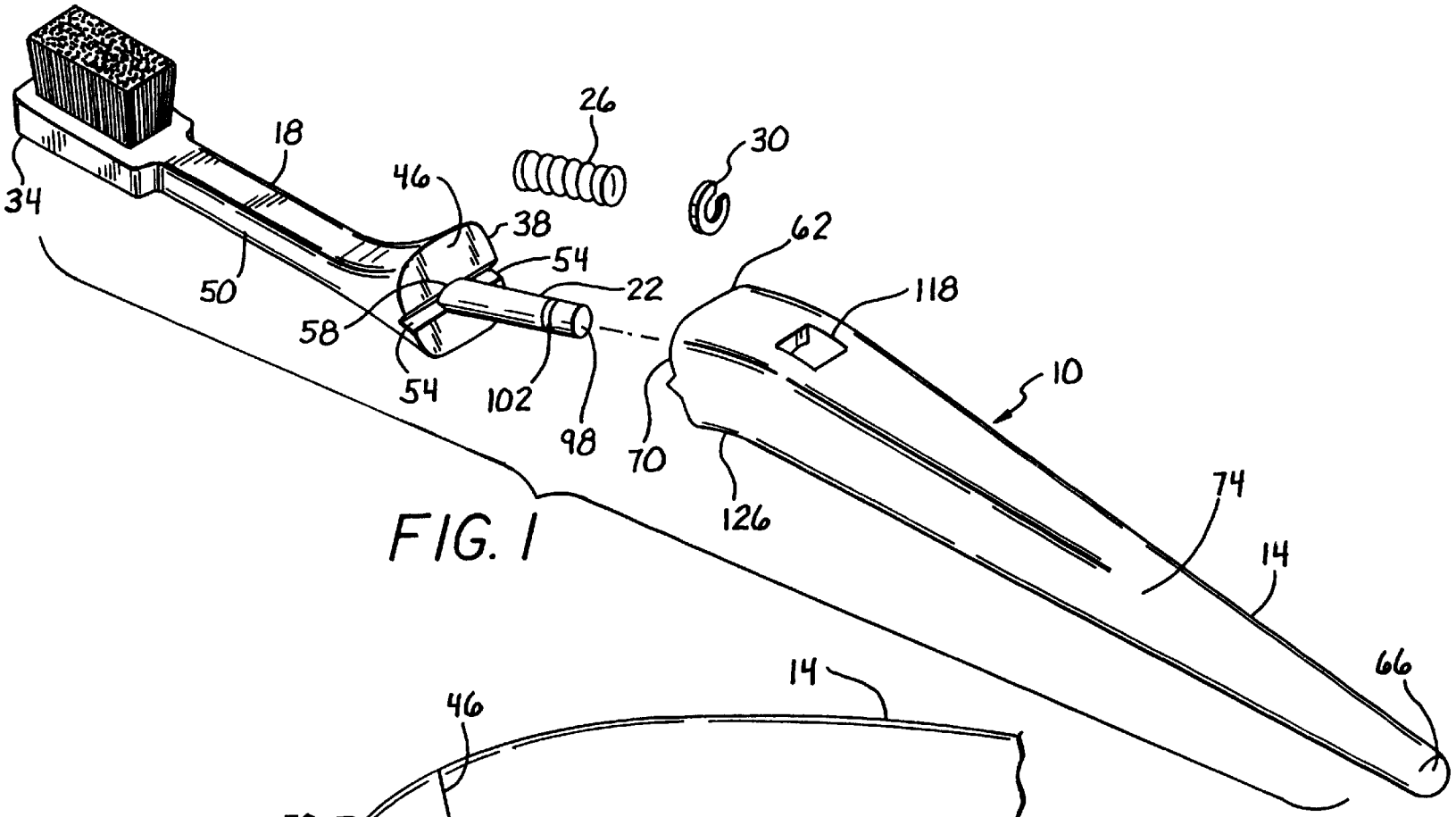
FIG. 1 is an exploded perspective view of an embodiment of the toothbrush of the present invention in its straight position.
Figure 2:
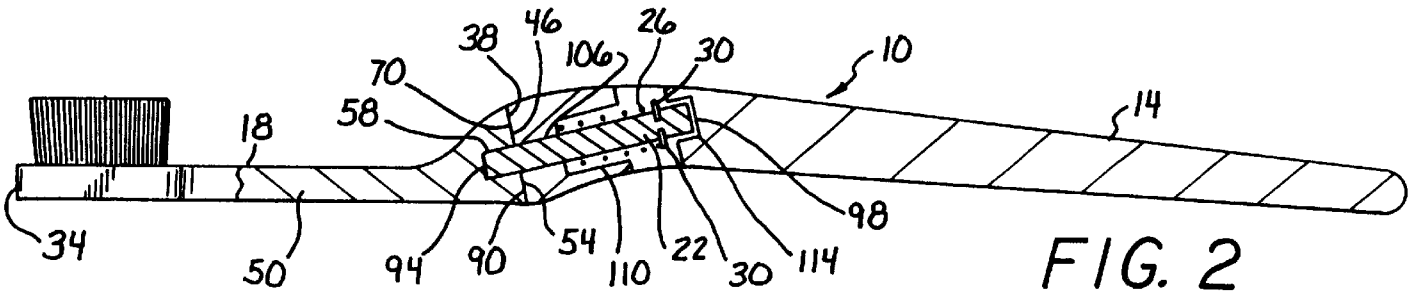
FIG. 2 is a cross-sectional side elevation of the toothbrush shown in FIG. 1.
Figure 4:
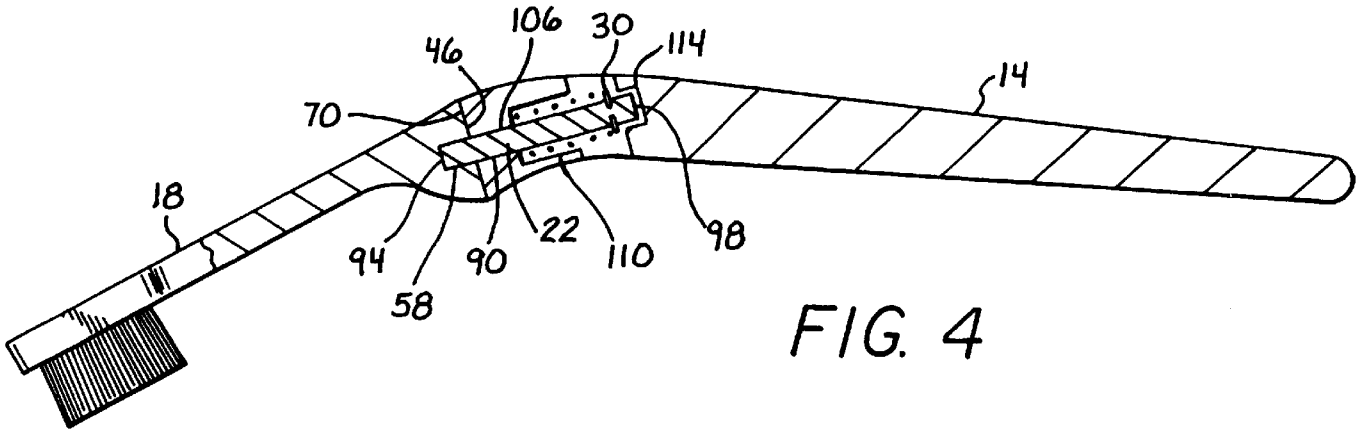
FIG. 4 is a cross-sectional side elevation of the toothbrush shown in FIG. 1 in its angled position.

FIGS. 1, 2 and 4 of the application illustrate a preferred embodiment of the toothbrush 10 with the handle 14 positioned in straight and angled positions with respect to the brush head member 18. These Figures illustrate that the invention permits a toothbrush 10 of relatively conventional form and appearance. Referring to FIG. 1, the toothbrush 10 is constructed of two moldable parts, a pin 22, a coil spring 26 and a retaining clip 30. The two parts are the rotatable brush head member 18 and the handle 14. The brush head member 18 is elongated and rigid has a predetermined length, with a forward end 34 and an after end 38. The forward end 34 supports a brush array 42. The brush array 42 extends laterally from the member's length. The after end 38 of the member 18 is flared and terminates in an essentially flat first surface 46 angled at less than 90 degrees with respect to a long axis 50 of the member 18. This first angled surface 46 includes a series of symmetrical locking features 54. The brush head member 18 has a first axial bore 58 commencing at the first angled surface 46 and which is orthogonal to the angled surface and terminates inwardly. The first axial bore 58 is sized to closely fit a pin 22 secured in the member 18.

Figure 5:
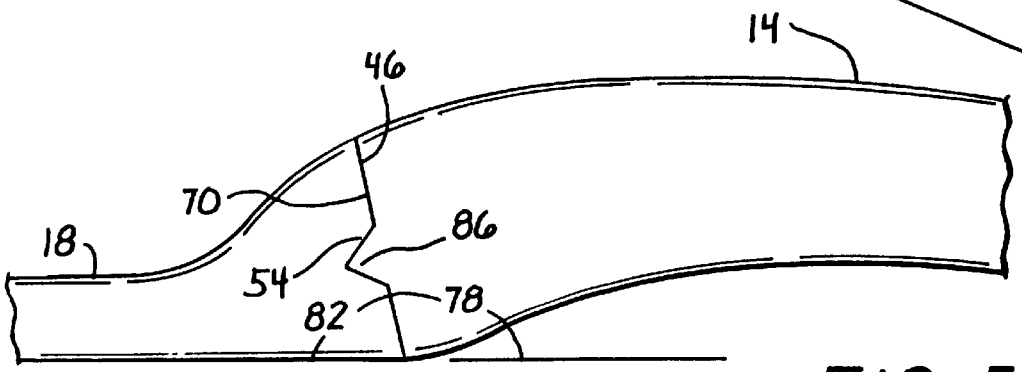
FIG. 5 is a side elevation detail of the toothbrush shown in FIG. 1 illustrating the symmetrical locking means of the brush head member and the handle.
Figure 3:
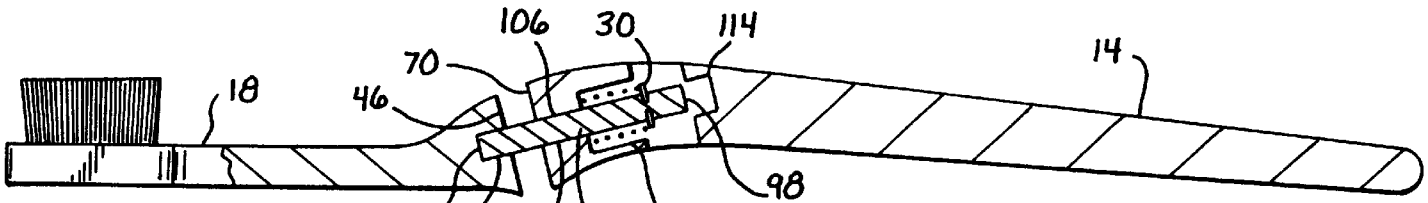
FIG. 3 is a cross-sectional of side elevation of the toothbrush shown in FIG. 1 with the brush head member partially withdrawn from the handle.

As shown in FIGS. 1, and 5, the handle 14 has a predetermined length, with a forward end 62 and an after end 66. The forward end 62 of the handle 14 terminates in an essentially flat second surface 70 angled to the long axis 74 of the handle 14 at an angle 78 complementary to the included angle 82 between the angled surface 46 of the brush head member 18 and the long axis 74 of the member 18. The sum of the two angles 78, 82 is approximately 180 degrees. The second angled surface 70 includes a series of mating symmetrical locking features 86 configured to mate with the symmetrical locking features 54 of the first angled surface 46 of the brush head member 18. As seen in FIGS. 2, 3 and 4, the handle 14 has a second axial bore 90 beginning at the second angled surface 70 and orthogonal to the second angled surface 70 and terminating inwardly.

As illustrated in FIGS. 1–4, the pin 22 has a cylindrical cross-section and has a forward end 94 and an after end 98. The pin 22 includes means for permanently securing the forward end 94 of the pin 22 within the first axial bore 58. The after end 98 of the pin 22 includes an annular groove 102 sized to accommodate the retaining clip 30.

As seen in FIGS. 2–4, the second axial bore 90 has an outer portion 106 sized to slidably accommodate the pin 22, a central portion 110 sized to slidably accommodate the pin 22 when surrounded by the coil spring 26, and an inner portion 114 sized to slidably accommodate the pin 22. As shown in FIGS. 1–4, the handle 14 includes at least one transverse opening 118 at the central portion 110 of the second axial bore 90 to permit placement of the coil spring 26 and attachment of the retaining clip 30. The brush head member 18 is secured to the handle 14 by inserting the coil spring 26 into the central portion 110 of the second axial bore 90 through the transverse opening 118. The after end 98 of the pin 22 is then inserted into the second axial bore 90 and through the coil spring 26, and then the retaining clip 30 is attached to the annular groove 102 in the after end of the pin 22. The coil spring 26 is thereby compressed between the outer portion of the second axial bore 106 and the retaining clip 30 and thus urges the pin 22 to withdraw into the handle 14, As illustrated in FIGS. 2–4, the brush head member 18 is aligned with the handle 14 in a first alternative angular position by pulling the brush head member 18 away from the handle 14 until the coil spring 26 is sufficiently compressed that the symmetrical locking features 54, 86 of the brush head member 18 and the handle 14, respectively, are disengaged from each other. The brush head member 18 is then twisted with respect to the handle 14 to the desired position and then released, allowing the symmetrical locking features 54 of the first angled surface 46 of the brush head member 18 to engage the mating symmetrical locking features 86 of the second angled surface 70 of the handle 14.

The brush head member 18 is aligned with the handle 14 in a second alternative angular position by pulling the brush head member 18 away from the handle 14 until the coil spring 26 is sufficiently compressed that the symmetrical locking features 54, 86 of the brush head member 18 and the handle 14 are disengaged from each other. The brush head member 18 is then twisted with respect to the handle 14 approximately 180 degrees and then released allowing the symmetrical locking features 54 of the first angled surface 46 of the brush head member 18 to engage the mating symmetrical locking features 86 of the second angled surface 70 of the handle 14.

As shown in FIG. 4, when the handle 14 is twisted to a first position and released so that the symmetrical locking features 54, 86 align, the resulting toothbrush 10 will have an essentially straight configuration. When the handle 14 is again pulled partially away from the brush head member 18 and twisted approximately 180 degrees to a second position and the handle 14 is released so that the mating locking features 54, 86 align, the resulting toothbrush 10 will have a handle 18 offset from the brush head member 18. As shown in FIG. 4, the offset angle 122 is the difference between 180 degrees and the sum of the included angle 82 between the long axis of the brush head member 18 and its angled surface 46 and the included angle 78 between the long axis 74 of the handle 14 and its angled surface 70. For example, if the angled surfaces 46 of the brush head member 18 and the handle 14 are each angled at 75 degrees to their long axes 50, 74, the sum of their included angles would be 150 degrees. The difference between this sum and 180 degrees is 30 degrees, the resulting offset 122 of the handle 14 from the brush head member 18.

As seen in FIGS. 1 and 5 the handle 14 includes finger-gripping features 126. A illustrated in FIG. 5, the symmetrical locking features 54 comprise one or more pairs of v-shaped grooves on the first angled surface 46 of brush head member and one or more pairs of mating v-shaped projections on the second angled surface 70 of the handle 14. The v-shaped grooves and v-shaped projections extend radially from the first axial bore 58 and the second axial bore 90, respectively.

It may be seen from the foregoing description, that an adjustable angle toothbrush 10 may be provided by the present invention which maybe manufactured and assembled easily by the use of molded parts, and when assembled, may be simply operated to allow two angular adjustments with respect to the axis of the handle.

The toothbrush 10 has been described with reference to a particular embodiment. However, it should be obvious to those skilled in the art to which this invention pertains that other modifications and enhancements can be made without departing from the spirit and scope of the claims that follow.

What is claimed is:

1. An angularly adjustable toothbrush comprising:

a pin of cylindrical cross-section having a forward end and an after end;

an elongated brush head member, said member having a predetermined length, with a forward end and an after end, the forward end supporting a brush array extending laterally, and the after end of said member being flared outwardly and terminating in an essentially flat first surface angled with respect to a long axis of said member;

said first angled surface including a first series of symmetrical locking features;

said member having a first axial bore commencing at said first angled surface and orthogonal thereto and terminating inwardly;

said first axial bore sized to closely fit the pin disposed therein;

a handle having a predetermined length, with a forward end and an after end, the forward end of said handle being flared outwardly and terminating in an essentially flat second angled surface angled with respect to a long axis of said handle;

said second angled surface including a second series of symmetrical locking features configured to mate with said first symmetrical locking features of said first angled surface of said brush head member;

said handle having a second axial bore commencing at said second angled surface and orthogonal thereto and terminating inwardly;

means for permanently securing the forward end of said pin within said first axial bore; and said pin including, at the after end, a rotatable means for securing the pin within said second axial bore.

2. The angularly adjustable toothbrush as described in claim 1 wherein the handle includes finger-gripping features.

3. The angularly adjustable toothbrush as described in claim 1 wherein the symmetrical locking features on the first angled surface of brush head member and the second angled surface of the handle comprise:

one or more pairs of v-shaped grooves on the first angled surface of brush head extending radially outward from said first axial bore; and one or more pairs of mating v-shaped projections on the second angled surface of handle extending radially outward from said second axial bore.

4. An angularly adjustable toothbrush comprising:

a pin of cylindrical cross-section having a forward end and an after end;

an elongated brush head member, said member having a predetermined length, with a forward end and an after end, the forward end supporting a brush array extending laterally, and the after end of said member being flared outwardly and terminating in an essentially flat first surface angled with respect to a long axis of said member;

said member having a first axial bore commencing at said first angled surface and orthogonal thereto and terminating inwardly;

said first angled surface including a first series of symmetrical locking features;

a handle having a predetermined length, with a forward end and an after end, the forward end of said handle being flared outwardly and terminating in an essentially flat second angled surface angled with respect to a long axis of said handle;

said handle having a second axial bore commencing at said second angled surface and orthogonal thereto and terminating inwardly;

said second angled surface including a second series of symmetrical locking features configured to mate with said symmetrical locking features of said first angled surface of said brush head member;

said forward end of said pin being fixedly secured within said first axial bore;

said after end of said pin including an annular groove sized to accommodate a retaining clip;

said second axial bore having an outer portion sized to slidably accommodate said cylindrical pin, a central portion sized to slidably accommodate the pin when surrounded by a coil spring, and an inner portion sized to slidably accommodate the pin;

said handle including at least one transverse opening at the central portion of the second axial bore to permit placement of the coil spring and attachment of the retaining clip;

said brush head member being secured to said handle by inserting the coil spring into the central portion of the second axial bore through the transverse opening, inserting the after end of the pin into the second axial bore and through the coil spring, and then attaching the retaining clip to the annular groove in the after end of the pin;

said coil spring being thereby compressed between the outer portion of the second axial bore and the retaining clip and thereby urging the pin to withdraw into the handle;

said brush head being aligned to the handle in a first alternative angular position by pulling the brush head away from the handle until the coil spring is sufficiently compressed that the symmetrical locking features of the brush head member are disengaged from the mating symmetrical locking features of the handle and twisting the brush head member with respect to the handle to the desired position and then releasing the brush head member and allowing the symmetrical locking features of the first angled surface of the brush head member to engage the mating symmetrical locking features of the second angled surface of the handle; and said brush head being aligned to the handle in a second alternative angular position by pulling the brush head away from the handle until the coil spring is sufficiently compressed that the symmetrical locking features of the brush head member are disengaged from the mating symmetrical locking features of the handle and twisting the brush head member with respect to the handle approximately 180 degrees and then releasing the brush head member and allowing the symmetrical locking features of the first angled surface of the brush head member to engage the mating symmetrical locking features of the second angled surface of the handle.

5. The angularly adjustable toothbrush as described in claim 4 wherein the handle includes finger-gripping features.

6. The angularly adjustable toothbrush as described in claim 4 wherein the symmetrical locking features on the first angled surface of brush head member and the second angled surface of the handle comprise:

one or more pairs of v-shaped grooves on the first angled surface of brush head extending radially outward from said first axial bore; and one or more pairs of mating v-shaped projections on the second angled surface handle extending radially outward from said second axial bore.

* * * * *